US008220294B2

(12) United States Patent
Lim et al.

(10) Patent No.: US 8,220,294 B2
(45) **Date of Patent: *Jul. 17, 2012**

(54) DRUM-TYPE WASHING MACHINE

(75) Inventors: Hee Tae Lim, Seoul (KR); Jae Won Chang, Seoul (KR); Hyun Seok Seo, Seoul (KR); Min Gyu Jo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/239,445

(22) Filed: Sep. 22, 2011

(65) Prior Publication Data

US 2012/0047963 A1 Mar. 1, 2012

Related U.S. Application Data

(63) Continuation of application No. 12/940,138, filed on Nov. 5, 2010, which is a continuation of application No. 12/230,031, filed on Aug. 21, 2008, now Pat. No. 7,841,220, which is a continuation-in-part of application No. 11/529,759, filed on Sep. 29, 2006, now Pat. No. 7,827,834.

(30) Foreign Application Priority Data

Sep. 30, 2005 (KR) ..... 10-2005-0092609

(51) Int. Cl.
*D06F 29/00* (2006.01)

(52) U.S. Cl. ..... 68/23.1; 68/140; 68/23 R; 68/13 R

(58) Field of Classification Search ..... 68/13 R, 68/19, 23 R, 23.1, 139, 140
See application file for complete search history.

(56) References Cited

U.S. PATENT DOCUMENTS

| | | | | |
|---|---|---|---|---|
| 912,038 | A | 2/1909 | Seifert | |
| 1,077,043 | A | 10/1913 | Darrow | |
| 1,470,245 | A | 10/1923 | Slider | |
| 1,611,865 | A | 12/1926 | Ahlm | |
| 1,611,895 | A | 12/1926 | Dienner | |
| 1,657,181 | A | 1/1928 | Sando | |
| 1,787,427 | A | 1/1931 | Eckhard | 68/140 |
| 2,089,066 | A | 8/1937 | Morrill | 248/26 |
| 2,096,649 | A | 10/1937 | Rasanen | |
| 2,152,458 | A | 3/1939 | Bergman | 172/36 |
| 2,153,418 | A | 4/1939 | Haberstump | 286/5 |
| 2,165,884 | A | 7/1939 | Chamberlin et al. | 8/159 |
| 2,191,607 | A | 2/1940 | Chamberlin et al. | 237/20 |

(Continued)

FOREIGN PATENT DOCUMENTS

CN 2423308 Y 3/2001

(Continued)

OTHER PUBLICATIONS

European Office Action issued in EP Application No. 10 012 465.0-2314 dated Dec. 7, 2011.

(Continued)

*Primary Examiner* — Michael Kornakov
*Assistant Examiner* — Katelyn Whatley
(74) *Attorney, Agent, or Firm* — KED & Associates, LLP

(57) ABSTRACT

A drum-type washing machine is disclosed, in which bearings are received in the bearing housing assembly. The bearing housing assembly may include a support portion coupled to a motor, and a coupling portion connected to a damper bracket.

16 Claims, 9 Drawing Sheets

U.S. PATENT DOCUMENTS

| | | | | |
|---|---|---|---|---|
| 2,217,351 | A | 10/1940 | Soderquist | |
| 2,230,345 | A | 2/1941 | Bradbury | |
| 2,278,911 | A | 4/1942 | Breckenridge | |
| 2,296,257 | A | 9/1942 | Breckenridge | 68/24 |
| 2,296,261 | A | 9/1942 | Breckenridge et al. | 68/24 |
| 2,296,267 | A | 9/1942 | Baird | 68/23 |
| 2,323,765 | A | 7/1943 | Haberstump | 68/13 |
| 2,331,897 | A | 10/1943 | Dyer | |
| 2,356,816 | A | 8/1944 | Breckenridge et al. | 68/12 |
| 2,356,818 | A | 8/1944 | Bruckman | 68/24 |
| 2,389,774 | A | 11/1945 | Haberstump | 220/10 |
| 2,408,509 | A | 10/1946 | Clark | 68/23 |
| 2,434,476 | A | 1/1948 | Wales | 68/19 |
| 2,498,181 | A | 2/1950 | Reiter | 259/81 |
| 2,509,516 | A | 5/1950 | Murphy | 29/215 |
| 2,510,836 | A | 6/1950 | Russell et al. | 68/24 |
| 2,521,578 | A | 9/1950 | Haberstump | 68/19 |
| 2,526,002 | A | 10/1950 | Brotman | 68/140 |
| 2,526,048 | A | 10/1950 | Russell | 68/24 |
| 2,526,444 | A | 10/1950 | Woodson | |
| 2,527,239 | A | 10/1950 | Woodson | 68/23 |
| 2,541,166 | A | 2/1951 | Leef | 68/140 |
| 2,542,509 | A | 2/1951 | Goriup | 68/153 |
| 2,555,269 | A | 5/1951 | Chamberlin | |
| 2,556,490 | A | 6/1951 | Chamberlin | 8/159 |
| 2,565,604 | A | 8/1951 | Geiger | 68/140 |
| 2,579,472 | A | 12/1951 | Chamberlin et al. | 68/24 |
| 2,579,836 | A | 12/1951 | Lee et al. | 260/26 |
| 2,589,284 | A | 3/1952 | O'Neil | 34/77 |
| 2,593,752 | A | 4/1952 | Haberstump | 68/61 |
| 2,615,320 | A | 10/1952 | Belaieff | 68/24 |
| 2,620,070 | A | 12/1952 | Dodge | 210/365 |
| 2,629,245 | A | 2/1953 | Chamberlin | |
| 2,644,326 | A | 7/1953 | Worst | 68/23 |
| 2,652,708 | A | 9/1953 | Rimsha et al. | |
| 2,656,700 | A | 10/1953 | Smith | 68/23 |
| 2,711,297 | A | 6/1955 | Thiele | 248/18 |
| 2,717,135 | A | 9/1955 | Douglas | 248/20 |
| 2,737,799 | A | 3/1956 | Knipmeyer | |
| 2,757,531 | A | 8/1956 | Fox | |
| 2,758,685 | A | 8/1956 | Sisson | 192/3.5 |
| 2,774,621 | A | 12/1956 | Kilbourne, Jr. | 228/23 |
| 2,785,557 | A | 3/1957 | Stilwell, Jr. | 68/12 |
| 2,836,046 | A | 5/1958 | Smith | 68/24 |
| 2,843,314 | A | 7/1958 | Hansen | 230/232 |
| 2,844,225 | A | 7/1958 | Hubbard et al. | |
| 2,859,877 | A | 11/1958 | Sisson | |
| 2,873,599 | A | 2/1959 | Buechler | 68/24 |
| 2,882,706 | A | 4/1959 | Brucken | 68/23 |
| 2,893,135 | A | 7/1959 | Smith | |
| 2,895,319 | A | 7/1959 | Rochefort | 68/3 |
| 2,908,871 | A | 10/1959 | McKay | 331/108 |
| 2,930,217 | A | 3/1960 | Rehmke | 68/24 |
| 2,937,516 | A | 5/1960 | Czaika | |
| 2,957,330 | A | 10/1960 | Cline | |
| 2,959,966 | A | 11/1960 | Bochan | |
| 2,972,877 | A | 2/1961 | Platt | 68/18 |
| 2,975,528 | A | 3/1961 | Shewmon | |
| 2,984,094 | A | 5/1961 | Belaieff | 68/24 |
| 2,986,914 | A | 6/1961 | Brucken | 68/12 |
| 2,987,190 | A | 6/1961 | Bochan | |
| 2,990,706 | A | 7/1961 | Bochan | 68/12 |
| 2,995,023 | A | 8/1961 | Douglas | 68/131 |
| 2,995,918 | A | 8/1961 | Neidenthal et al. | |
| 2,987,189 | A | 9/1961 | Evjen | |
| 3,048,026 | A | 8/1962 | Bochan et al. | 68/12.09 |
| 3,058,331 | A | 10/1962 | Anthony | |
| 3,066,522 | A | 12/1962 | Steinmüller | 68/24 |
| 3,073,668 | A | 1/1963 | Rothenberger | |
| 3,089,326 | A | 5/1963 | Belaieff | 68/24 |
| 3,098,581 | A | 7/1963 | Marsilio | 220/46 |
| 3,135,688 | A | 6/1964 | Compans et al. | |
| 3,153,951 | A | 10/1964 | Whelan | 74/665 |
| 3,178,916 | A * | 4/1965 | Belaieff et al. | 68/23.2 |
| 3,197,983 | A | 8/1965 | Ilmer | 68/24 |
| 3,206,267 | A | 9/1965 | Gruner et al. | 312/228 |
| 3,248,908 | A | 5/1966 | Pope | |
| 3,257,830 | A | 6/1966 | Shelton | 68/133 |
| 3,273,361 | A | 9/1966 | Smith | 68/12 |
| 3,280,603 | A | 10/1966 | Schwamm | |
| 3,333,444 | A | 8/1967 | Bochan | 68/208 |
| 3,356,222 | A | 12/1967 | Belaieff | 210/363 |
| 3,362,198 | A | 1/1968 | Barito | |
| 3,389,881 | A | 6/1968 | Stelwagen | 248/18 |
| 3,391,469 | A | 7/1968 | Reeder | 34/58 |
| 3,459,461 | A | 8/1969 | Bannon, Jr. | 213/214 |
| 3,477,259 | A | 11/1969 | Barnish et al. | 68/23.1 |
| 3,503,228 | A | 3/1970 | Lake | |
| 3,509,742 | A | 5/1970 | Bauer | 68/23.1 |
| 3,531,954 | A | 10/1970 | Ksupsky | 68/18 |
| 3,742,738 | A | 7/1973 | Frotriede | |
| 3,783,653 | A | 1/1974 | Haerick | |
| 3,799,348 | A | 3/1974 | Mazza | |
| 3,927,542 | A | 12/1975 | de Hedouville et al. | 68/17 |
| 3,952,557 | A | 4/1976 | Bochan | |
| 4,114,406 | A | 9/1978 | Horowitz et al. | 68/24 |
| 4,295,387 | A | 10/1981 | Zhivotov et al. | 74/573 |
| 4,321,302 | A | 3/1982 | Umeki et al. | |
| 4,412,390 | A | 11/1983 | Grant | 34/58 |
| 4,437,325 | A | 3/1984 | Hershberger | |
| 4,446,706 | A | 5/1984 | Hartwig | 68/24 |
| 4,498,181 | A | 2/1985 | Menown et al. | 372/38 |
| 4,618,193 | A | 10/1986 | Cuthbert et al. | 312/264 |
| 4,771,253 | A | 9/1988 | Sasaki et al. | |
| 4,819,460 | A | 4/1989 | Obradovic | 68/23.7 |
| 4,989,684 | A | 2/1991 | Conaway | 180/89.15 |
| 5,038,586 | A | 8/1991 | Nukaga et al. | 68/12.01 |
| 5,080,204 | A | 1/1992 | Bauer et al. | 188/129 |
| 5,199,690 | A | 4/1993 | Marshall | 267/64.25 |
| 5,209,458 | A | 5/1993 | Eubank et al. | 254/88 |
| 5,230,229 | A | 7/1993 | Stadelmann et al. | 68/23.1 |
| 5,267,456 | A | 12/1993 | Nukaga et al. | 68/12.24 |
| 5,280,660 | A | 1/1994 | Pellerin et al. | 8/158 |
| 5,433,091 | A | 7/1995 | Durazzani et al. | |
| 5,526,657 | A | 6/1996 | Johnson | 68/3 |
| 5,548,979 | A | 8/1996 | Ryan et al. | |
| 5,570,597 | A | 11/1996 | Bongini et al. | |
| 5,657,649 | A | 8/1997 | Lim | 68/23.3 |
| 5,678,430 | A | 10/1997 | Merlin et al. | |
| 5,711,170 | A | 1/1998 | Johnson | 68/3 |
| 5,711,171 | A | 1/1998 | Uhlin | 68/4 |
| 5,768,730 | A | 6/1998 | Matsumoto et al. | 8/159 |
| 5,870,905 | A | 2/1999 | Imamura et al. | 68/12.04 |
| 5,907,880 | A | 6/1999 | Durazzani et al. | |
| 5,913,951 | A | 6/1999 | Herr et al. | 81/158 |
| 5,924,312 | A | 7/1999 | Vande Haar | |
| 5,961,105 | A | 10/1999 | Ehrnsberger et al. | 267/216 |
| 5,979,195 | A | 11/1999 | Bestell et al. | 68/23.2 |
| 6,032,494 | A | 3/2000 | Tanigawa et al. | 68/12.06 |
| 6,122,843 | A | 9/2000 | Noguchi et al. | 34/596 |
| 6,148,647 | A | 11/2000 | Kabeya et al. | 68/140 |
| 6,343,492 | B1 | 2/2002 | Seagar et al. | 68/142 |
| 6,363,756 | B1 | 4/2002 | Seagar et al. | 68/210 |
| 6,460,382 | B1 * | 10/2002 | Kim et al. | 68/140 |
| 6,474,114 | B1 | 11/2002 | Ito et al. | 68/140 |
| 6,477,867 | B1 | 11/2002 | Collecutt et al. | 68/12.06 |
| 6,481,035 | B2 | 11/2002 | Seagar et al. | 81/159 |
| 6,510,715 | B1 | 1/2003 | Simsek et al. | 68/12.06 |
| 6,510,716 | B1 | 1/2003 | Kim et al. | 68/24 |
| 6,516,638 | B1 | 2/2003 | Myerscough | 68/23.1 |
| 6,539,753 | B1 | 4/2003 | Ito et al. | 68/3 |
| 6,557,383 | B1 | 5/2003 | Ito et al. | 68/23.2 |
| 6,564,594 | B1 | 5/2003 | Ito et al. | 68/24 |
| 6,578,225 | B2 | 6/2003 | Jönsson | 8/159 |
| 6,578,391 | B2 | 6/2003 | Seagar et al. | 68/142 |
| 6,612,138 | B2 | 9/2003 | Ryu et al. | |
| 6,626,014 | B2 | 9/2003 | Heyder et al. | 68/140 |
| 6,662,682 | B2 | 12/2003 | Stalsberg | |
| 6,681,602 | B2 | 1/2004 | Heyder et al. | |
| 6,782,722 | B2 | 8/2004 | Yokoi et al. | |
| 6,968,632 | B2 | 11/2005 | Guinibert et al. | |
| 6,981,395 | B2 | 1/2006 | Ryu et al. | 68/17 |
| 7,013,682 | B2 | 3/2006 | Sharrow | |
| 7,065,905 | B2 | 6/2006 | Guinibert et al. | |
| 7,073,356 | B2 | 7/2006 | Nakamura et al. | 68/12.26 |
| 7,117,613 | B2 | 10/2006 | Guinibert et al. | |
| 7,225,562 | B2 | 6/2007 | Guinibert et al. | |

| | | | | |
|---|---|---|---|---|
| 7,249,742 | B2 | 7/2007 | Guinibert et al. | |
| 7,257,905 | B2 | 8/2007 | Guinibert et al. | |
| 7,334,799 | B2 | 2/2008 | O'Hara | 277/361 |
| 7,412,783 | B2 | 8/2008 | Guinibert et al. | |
| 7,467,483 | B2 | 12/2008 | Guinibert et al. | |
| 7,536,882 | B2 | 5/2009 | Kim et al. | |
| 7,762,007 | B2 | 7/2010 | Guinibert et al. | |
| 7,841,220 | B2 | 11/2010 | Lim et al. | |
| 2002/0000108 | A1 | 1/2002 | Heyder et al. | |
| 2002/0014095 | A1 | 2/2002 | Seagar et al. | |
| 2002/0042957 | A1 | 4/2002 | Kim et al. | |
| 2002/0166349 | A1 | 11/2002 | Lim et al. | 68/23.7 |
| 2003/0056302 | A1 | 3/2003 | Broker et al. | 8/159 |
| 2003/0061841 | A1 | 4/2003 | Nakamura et al. | |
| 2004/0025544 | A1 | 2/2004 | Kim et al. | 68/3 |
| 2004/0031295 | A1 | 2/2004 | Choi | 68/24 |
| 2004/0035155 | A1 | 2/2004 | Yoon | 68/145 |
| 2004/0123631 | A1 | 7/2004 | Chang | 68/23.1 |
| 2004/0129035 | A1 | 7/2004 | Chang | 68/23 |
| 2004/0163425 | A1 | 8/2004 | Kim et al. | |
| 2004/0163428 | A1* | 8/2004 | Kim et al. | 68/140 |
| 2004/0237603 | A1 | 12/2004 | Kim et al. | 68/15 |
| 2004/0244121 | A1 | 12/2004 | Lim et al. | 8/159 |
| 2004/0244168 | A1 | 12/2004 | Lee | 29/283.5 |
| 2004/0244438 | A1 | 12/2004 | North | |
| 2005/0028564 | A1 | 2/2005 | Lee et al. | 68/24 |
| 2005/0188472 | A1 | 9/2005 | Park et al. | 8/158 |
| 2005/0274159 | A1 | 12/2005 | Jeon et al. | |
| 2006/0010612 | A1 | 1/2006 | Kim et al. | 8/158 |
| 2006/0011429 | A1 | 1/2006 | Park et al. | 188/322.13 |
| 2006/0016228 | A1* | 1/2006 | Chang et al. | 68/23.1 |
| 2006/0254321 | A1* | 11/2006 | Lim et al. | 68/12.01 |
| 2007/0125135 | A1* | 6/2007 | Kim et al. | 68/140 |
| 2007/0227200 | A1* | 10/2007 | Kim et al. | 68/140 |

FOREIGN PATENT DOCUMENTS

| | | | |
|---|---|---|---|
| CN | 1332816 | A | 1/2002 |
| CN | 1511997 | A | 7/2004 |
| CN | 1515732 | A | 7/2004 |
| CN | 1550609 | A | 12/2004 |
| DE | 1 188 547 | | 3/1965 |
| DE | 19 12 481 | U | 3/1965 |
| DE | 24 01 888 | A1 | 7/1975 |
| DE | 24 54 489 | A1 | 5/1976 |
| DE | 26 06 589 | | 9/1976 |
| DE | 27 32 684 | A1 | 2/1978 |
| DE | 27 46 989 | A1 | 4/1978 |
| DE | 31 09 641 | A1 | 2/1982 |
| DE | 31 34 633 | A1 | 8/1982 |
| DE | 34 37 835 | A1 | 5/1985 |
| DE | 37 13 921 | | 11/1988 |
| DE | 38 11 583 | A1 | 10/1989 |
| DE | 39 07 258 | A1 | 10/1989 |
| DE | 39 34 434 | A1 | 4/1991 |
| DE | 42 39 504 | A1 | 5/1994 |
| DE | 43 10 594 | A1 | 10/1994 |
| DE | 4 426 900 | | 2/1995 |
| DE | 43 30 079 | A1 | 3/1995 |
| DE | 198 06 884 | | 8/1999 |
| DE | 199 61 780 | | 7/2001 |
| EP | 0 124 939 | B1 | 11/1984 |
| EP | 0 132 805 | A1 | 2/1985 |
| EP | 0 212 259 | | 3/1987 |
| EP | 0 272 949 | B1 | 6/1988 |
| EP | 0 371 926 | A1 | 6/1990 |
| EP | 0 405 068 | B1 | 1/1991 |
| EP | 0 465 885 | | 1/1992 |
| EP | 0 716 177 | B1 | 6/1996 |
| EP | 0 750 064 | A1 | 12/1996 |
| EP | 0 869 212 | | 10/1998 |
| EP | 0 943 720 | | 9/1999 |
| EP | 0 969 134 | A1 | 1/2000 |
| EP | 0 725 179 | B1 | 7/2000 |
| EP | 1 055 765 | A1 | 11/2000 |
| EP | 1 079 014 | B1 | 2/2001 |
| EP | 1 094 239 | B1 | 4/2001 |
| EP | 1 201 810 | | 5/2002 |
| EP | 1 386 996 | B1 | 2/2004 |
| EP | 1 433 890 | B1 | 6/2004 |
| EP | 1 433 891 | A2 | 6/2004 |
| EP | 1 455 011 | | 9/2004 |
| EP | 1 505 191 | A1 | 2/2005 |
| EP | 1 548 170 | | 6/2005 |
| EP | 1 605 088 | A2 | 12/2005 |
| EP | 1 619 286 | | 1/2006 |
| EP | 1 688 531 | A1 | 8/2006 |
| FR | 2 230 782 | | 1/1975 |
| FR | 2 478 151 | | 9/1981 |
| FR | 2 511 401 | | 2/1983 |
| FR | 2 610 017 | | 7/1988 |
| GB | 646582 | | 11/1950 |
| GB | 1120431 | | 7/1968 |
| GB | 1 181 797 | | 2/1970 |
| GB | 1 270 950 | | 4/1972 |
| GB | 1 353 283 | | 5/1974 |
| GB | 2 096 649 | A | 10/1982 |
| GB | 2 157 326 | A | 10/1985 |
| GB | 2 189 511 | | 10/1987 |
| GB | 2 202 867 | A | 10/1988 |
| GB | 2 360 296 | | 9/2001 |
| JP | 39-21844 | U | 7/1962 |
| JP | 48-64179 | | 8/1973 |
| JP | 49-135264 | | 11/1974 |
| JP | 52-134264 | | 11/1977 |
| JP | 54-028470 | | 3/1979 |
| JP | 56-116987 | A | 9/1981 |
| JP | 57-43792 | A | 3/1982 |
| JP | 59-211496 | A | 11/1984 |
| JP | 60-190998 | | 9/1985 |
| JP | 63-95587 | U | 6/1988 |
| JP | 01-230390 | | 9/1989 |
| JP | 02-189188 | | 7/1990 |
| JP | 03-141988 | | 6/1991 |
| JP | 03-88479 | U | 9/1991 |
| JP | 04-092697 | A | 3/1992 |
| JP | 04-210091 | | 7/1992 |
| JP | 04-220291 | | 8/1992 |
| JP | 04-236988 | A | 8/1992 |
| JP | 04-240488 | A | 8/1992 |
| JP | 04-325196 | | 11/1992 |
| JP | 04-371194 | A | 12/1992 |
| JP | 05-084388 | A | 4/1993 |
| JP | 05-084389 | | 4/1993 |
| JP | 05-220293 | A | 8/1993 |
| JP | 06-079087 | A | 3/1994 |
| JP | 09-066185 | | 3/1997 |
| JP | 09-182368 | | 7/1997 |
| JP | 09-182370 | A | 7/1997 |
| JP | 9-313780 | | 12/1997 |
| JP | 10-201993 | A | 8/1998 |
| JP | 10-263265 | | 10/1998 |
| JP | 11-076680 | A | 3/1999 |
| JP | 2000-262796 | A | 9/2000 |
| JP | 2000-334194 | A | 12/2000 |
| JP | 2002-153695 | A | 5/2002 |
| JP | 2002-529173 | T | 9/2002 |
| JP | 2002-346281 | A | 12/2002 |
| JP | 2003-079995 | | 3/2003 |
| JP | 2003-230792 | A | 8/2003 |
| JP | 2004-513721 | | 5/2004 |
| JP | 2004-188204 | | 7/2004 |
| JP | 2004-209255 | | 7/2004 |
| JP | 2005-198698 | | 7/2005 |
| JP | 2006-026408 | | 2/2006 |
| JP | 2006-034755 | | 2/2006 |
| KR | 10-1999-0066050 | A | 8/1999 |
| KR | 10-1999-0079731 | A | 11/1999 |
| KR | 10-2001-0009545 | A | 2/2001 |
| KR | 2001-0046776 | | 6/2001 |
| KR | 10-2004-0011307 | A | 2/2004 |
| KR | 10-2004-0047223 | A | 6/2004 |
| KR | 10-2004-0058999 | A | 7/2004 |
| KR | 10-2006-0009075 | | 1/2006 |
| KR | 10-2006-0028804 | | 4/2006 |
| SU | 1181112 | A | 9/1986 |
| SU | 1615258 | | 12/1990 |
| SU | 1663074 | A1 | 7/1991 |
| SU | 1 703 740 | | 1/1992 |

| | | | |
|---|---|---|---|
| WO | WO 98/29595 | A2 | 7/1998 |
| WO | WO 99/35320 | | 7/1999 |
| WO | WO 03/097918 | | 11/2003 |
| WO | WO 2005/071155 | | 8/2005 |

OTHER PUBLICATIONS

Office Action issued in U.S. Appl. No. 13/241,366 dated Jan. 31, 2012.
Notice of Allowance issued in U.S. Appl. No. 13/239,439 dated Feb. 9, 2012.
Notice of Allowance issued in U.S. Appl. No. 13/239,448 dated Feb. 10, 2012.
Office Action issued in U.S. Appl. No. 13/241,366 dated Feb. 10, 2012.
Office Action issued in U.S. Appl. No. 13/241,348 dated Feb. 23, 2012.
U.S. Office Action dated Dec. 30, 2005 issued in U.S. Appl. No. 10/461,451.
U.S. Final Office Action dated Aug. 14, 2006 issued in U.S. Appl. No. 10/461,451.
U.S. Final Office Action dated Dec. 13, 2006 issued in U.S. Appl. No. 10/461,451.
U.S. Office Action dated Jan. 5, 2007 issued in U.S. Appl. No. 11/475,885.
U.S. Office Action dated Apr. 27, 2007 issued in U.S. Appl. No. 10/461,451.
U.S. Office Action dated Jun. 8, 2007 issued in U.S. Appl. No. 11/470,704.
U.S. Office Action dated Nov. 30, 2007 issued in U.S. Appl. No. 11/470,704.
U.S. Final Office Action dated Jul. 17, 2007 issued in U.S. Appl. No. 11/475,885.
U.S. Office Action dated Nov. 19, 2007 issued in U.S. Appl. No. 10/461,451.
U.S. Office Action dated Apr. 1, 2008 issued in U.S. Appl. No. 11/475,885.
U.S. Final Office Action dated May 15, 2008 issued in U.S. Appl. No. 11/470,704.
U.S. Final Office Action dated Jun. 16, 2008 issued in U.S. Appl. No. 10/461,451.
U.S. Office Action dated Sep. 5, 2008 issued in U.S. Appl. No. 11/165,332.
U.S. Office Action dated Sep. 11, 2008 issued in U.S. Appl. No. 11/470,704.
U.S. Final Office Action dated Feb. 25, 2009 issued in U.S. Appl. No. 11/165,332.
U.S. Office Action dated Feb. 25, 2009 issued in U.S. Appl. No. 12/198,269.
Japanese Office Action dated Mar. 2, 2009 issued in Application No. 2004-000478.
Japanese Office Action dated Dec. 18, 2009 issued in Application No. 2004-000478.
U.S. Office Action dated Sep. 21, 2009 issued in U.S. Appl. No. 12/267,457.
U.S. Final Office Action dated Oct. 14, 2009 issued in U.S. Appl. No. 12/198,269.
U.S. Office Action dated Oct. 15, 2009 issued in U.S. Appl. No. 11/529,759.
U.S. Office Action dated Oct. 28, 2009 issued in U.S. Appl. No. 12/230,031.
Chinese Office Action issued in CN Application No. 200710089087.4 dated Jan. 8, 2010.
U.S. Office Action dated Feb. 2, 2010 issued in U.S. Appl. No. 12/198,269.
European Search Report dated Feb. 3, 2010 issued in Application No. 09178918.0.
U.S. Final Office Action dated Mar. 5, 2010 issued in U.S. Appl. No. 12/267,457.
Chinese Office Action dated Mar. 8, 2010 issued in Application No. 200610142200.6.
U.S. Final Office Action dated Mar. 19, 2010 issued in U.S. Appl. No. 11/529,759.
Notice of Opposition dated May 7, 2010 filed in the European Patent Office for European Patent Application No. 05013603.5 (Publication No. EP 1 619 286 B1).
U.S. Final Office Action dated May 14, 2010 issued in U.S. Appl. No. 12/230,031.
Japanese Office Action issued in JP Application No. 2005-204374 dated Jul. 28, 2010.
Japanese Office Action issued in JP Application No. 2006-235745 dated Aug. 3, 2010.
U.S. Office Action dated Aug. 13, 2010 issued in U.S. Appl. No. 12/639,872.
Notice of Opposition and Opposition Brief filed in EP Application No. 03013411.8 dated Sep. 29, 2010 (Publication No. EP 1 433 890 B1) (full German text and English translation).
U.S. Office Action issued in U.S. Appl. No. 12/797,758 dated Oct. 28, 2010.
European Search Report issued in EP Application No. 10012467 dated Nov. 25, 2010.
U.S. Office Action issued in U.S. Appl. No. 12/639,859 dated Dec. 9, 2010.
U.S. Office Action issued in U.S. Appl. No. 12/940,138 dated Dec. 16, 2010.
U.S. Office Action issued in U.S. Appl. No. 12/639,894 dated Dec. 23, 2010.
U.S. Office Action issued in U.S. Appl. No. 12/985,389 dated Mar. 16, 2011.
Final U.S. Office Action issued in U.S. Appl. No. 12/797,758 dated Mar. 17, 2011.
European Search Report issued in EP Application No. 10012465 dated Mar. 24, 2011.
European Search Report issued in EP Application No. 10012469 dated Apr. 8, 2011.
European Search Report issued in EP Application No. 10012470 dated Apr. 8, 2011.
U.S. Office Action issued in U.S. Appl. No. 12/940,096 dated Apr. 18, 2011.
Final U.S. Office Action issued in U.S. Appl. No. 12/639,859 dated Apr. 27, 2011.
European Search Report issued in EP Application No. 10012468 dated May 4, 2011.
Final U.S. Office Action issued in U.S. Appl. No. 12/940,138 dated May 20, 2011.
U.S. Final Office Action issued in U.S. Appl. No. 12/639,894 dated Aug. 3, 2011.
U.S. Final Office Action issued in U.S. Appl. No. 12/985,389 dated Aug. 8, 2011.
U.S. Final Office Action issued in U.S. Appl. No. 12/940,096 dated Sep. 8, 2011.
Summons to Attend Oral Proceedings issued in EP Application No. 03013411.8 dated Jul. 14, 2011.
Office Action issued in U.S. Appl. No. 13/116,059 dated Nov. 28, 2011.
Office Action issued in U.S. Appl. No. 13/116,096 dated Nov. 29, 2011.
Office Action issued in U.S. Appl. No. 13/116,114 dated Nov. 29, 2011.
Office Action issued in U.S. Appl. No. 13/116,077 dated Nov. 30, 2011.
Office Action issued in U.S. Appl. No. 13/116,089 dated Nov. 30, 2011.
Office Action issued in U.S. Appl. No. 13/116,159 dated Nov. 30, 2011.
Office Action issued in U.S. Appl. No. 13/116,147 dated Nov. 30, 2011.
Office Action issued in U.S. Appl. No. 13/116,105 dated Dec. 1, 2011.
Office Action issued in U.S. Appl. No. 13/239,424 dated Feb. 29, 2012.
Office Action issued in U.S. Appl. No. 13/211,411 dated Mar. 6, 2012.
Office Action issued in U.S. Appl. No. 13/239,427 dated Mar. 21, 2012.

Office Action issued in U.S. Appl. No. 13/241,337 dated Mar. 22, 2012.
Office Action issued in U.S. Appl. No. 13/239,416 dated Apr. 12, 2012.
Office Action issued in U.S. Appl. No. 13/116,089 dated Apr. 13, 2012.
Office Action issued in U.S. Appl. No. 13/116,077 dated Apr. 16, 2012.
Office Action issued in U.S. Appl. No. 13/116,096 dated Apr. 16, 2012.
Office Action issued in U.S. Appl. No. 13/116,114 dated Apr. 18, 2012.
Office Action issued in U.S. Appl. No. 13/116,159 dated Apr. 18, 2012.
Office Action issued in U.S. Appl. No. 13/239,430 dated May 4, 2012.
Office Action issued in U.S. Appl. No. 13/239,422 dated May 9, 2012.

* cited by examiner

DRUM-TYPE WASHING MACHINE

CROSS REFERENCE TO RELATED APPLICATIONS

This application is a continuation application of U.S. application Ser. No. 12/940,138 filed Nov. 5, 2010, which is a continuation application of U.S. application Ser. No. 12/230,031 filed Aug. 21, 2008 now U.S. Pat. No. 7,841,220, which is a continuation in part application of U.S. application Ser. No. 11/529,759 filed Sep. 29, 2006 now U.S. Pat. No. 7,827,834, which claims the benefit of Korean Application No. 10-2005-0092609, filed Sep. 30, 2005, which are hereby incorporated by reference as if fully set forth herein.

BACKGROUND OF THE INVENTION

1. Field of the Invention

The present invention relates to a drum-type washing machine. More particularly, the present invention is directed to a drum-type washing machine with a bearing housing assembly, in which a damper for damping vibration of a drum is connected to a damper bracket.

2. Discussion of the Related Art

FIG. 1 is a sectional view illustrating an inner structure of a related art drum-type washing machine, and FIG. 2 is a sectional view taken along line II-II of FIG. 1.

As shown in FIG. 1 or FIG. 2, the related art drum-type washing machine includes a cabinet 1 having a base 1*a* and a door 1*b*, a tub 2 provided in an inner side of the cabinet 1, a drum 3 rotatably disposed in the tub 2 to rotate laundry m and washing water filled therein by use of a lift 3*a*, a motor 4 for rotating the drum 3, a spring 5, a damper 6, and a balancer 7, wherein the spring 5, the damper 6 and the balancer 7 serve to attenuate vibration transferred to the tub 2.

The drum 3 is provided with a plurality of holes 3*b* to allow the washing water, which is stored in the tub 2, to flow into drum 3. The lift 3*a* is disposed in an inner side of the drum 3 and is rotated with the drum 3, whereby the laundry m inside the drum 3 is lifted and dropped by the lift 3*a*.

The tub 2 is spaced apart from the inner side of the cabinet 1 at a predetermined interval, and is connected to the cabinet 1 by springs 5. The damper 6 is connected to the tub 2 and the base 1*a* by a hinge so that the tub 2 can be supported by the base 1*a*. The spring 5 and the damper 6 serve to dampen vibration transferred from the tub 2 to the cabinet 1.

The door 1*b* of the cabinet 1 is rotatably provided on a front surface 1*d* so that laundry m can be loaded into the drum 3. Respective front surfaces 2*d* and 3*d* of the tub 2 and the drum 3 are provided with openings 2*c* and 3*c* so that the drum 3 is accessible through the opening associated with the door 1*b*.

A gasket 8 is disposed between the front surface 1*d* of the cabinet 1 provided with the door 1*b* and the front surface 2*d* of the tub 2, and serves to prevent the washing water from leaking out of the tub 2. The gasket 8 seals a gap formed between the inner side of the cabinet 1 and the front surface 2*d* of the tub 2.

The motor 4 is disposed on a rear surface of the tub 2 and serves to rotate the drum 3 disposed inside the tub 2.

The balancer 7 is disposed in the drum 3 and serves to balance the rotating drum 3. Also, the balancer 7 is formed with a predetermined weight and serves to attenuate vibration of the drum 3 produced by a centrifugal force acting on the drum 3 when it is rotated at high speeds during a dehydrating cycle, for example a spin cycle.

In the aforementioned related art drum-type washing machine, vibration generated by a rotating part, such as the drum or the motor, is directly transferred to the tub, whereby the vibration transferred to the tub is reduced by the damper connected with the tub. However, in this structure of the related art drum-type washing machine, since vibration still affects the tub, it should be spaced apart from the cabinet by a certain interval so that the vibration of the tub is not directly transferred to the cabinet.

For this reason, when the size of the tub is increased to increase the capacity of the washing machine, the size of the cabinet must also be increased.

Furthermore, in the structure of the related art drum-type washing machine, since the vibration of the tub is relatively severe and the damper for attenuating the vibration is directly connected with the tub, the design of the tub must consider a structure in view of rigidity and strength in order to effectively attenuate the vibration. The design of the structure, including the materials necessary to accomplish attenuating the vibration, increases the overall weight of the washing machine and affects the arrangement of other parts inside the cabinet. Accordingly, the structure causes an increase in the overall cost of manufacturing the washing machine.

SUMMARY OF THE INVENTION

Accordingly, the present invention is directed to a bearing housing assembly and a drum-type washing machine with the same, which substantially obviates one or more problems due to limitations and disadvantages of the related art.

An advantage of the present invention is to provide a bearing housing assembly and a drum-type washing machine with the same, in which the bearing housing assembly is formed by insert injection molding to improve durability of the drum-type washing machine and facilitate its assembly.

Additional advantages, objects, and features of the invention will be set forth in part in the description which follows, and in part will be apparent from the description, or may be learned from practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a bearing housing assembly of a drum-type washing machine, the bearing housing assembly including a first bearing housing, wherein the first bearing housing includes: a hub into which at least one bearing is inserted, the at least one bearing supporting a rotational shaft of a drum; a support portion extended from an outer circumference of the hub; and a coupling portion extended from the hub.

In another aspect of the present invention is a drum-type washing machine comprising: a tub receiving washing water therein; a drum rotatably disposed inside the tub; a drum rotational shaft transferring a rotational force of a motor to the drum; a damper bracket connected with a damper; and a bearing housing assembly formed including a first bearing housing, wherein the first bearing housing includes a hub into which at least one bearing is inserted, the at least one bearing supporting the drum rotational shaft, a support portion extended from an outer circumference of the hub, and a coupling portion extended from the hub.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
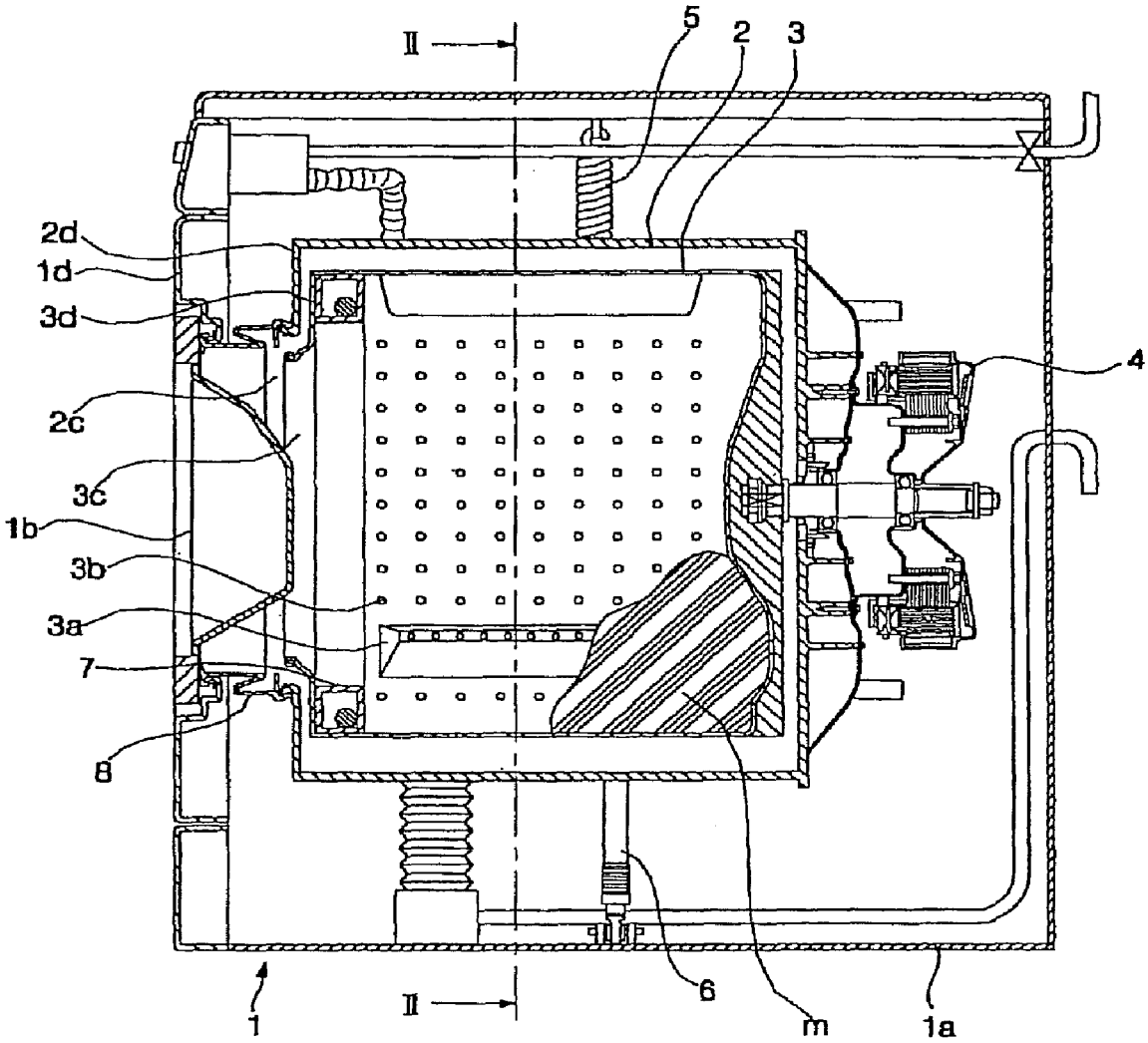
Fig. 1 Related Art
FIG. 1 is a sectional view illustrating an inner structure of a related art drum-type washing machine.
Figure 2:
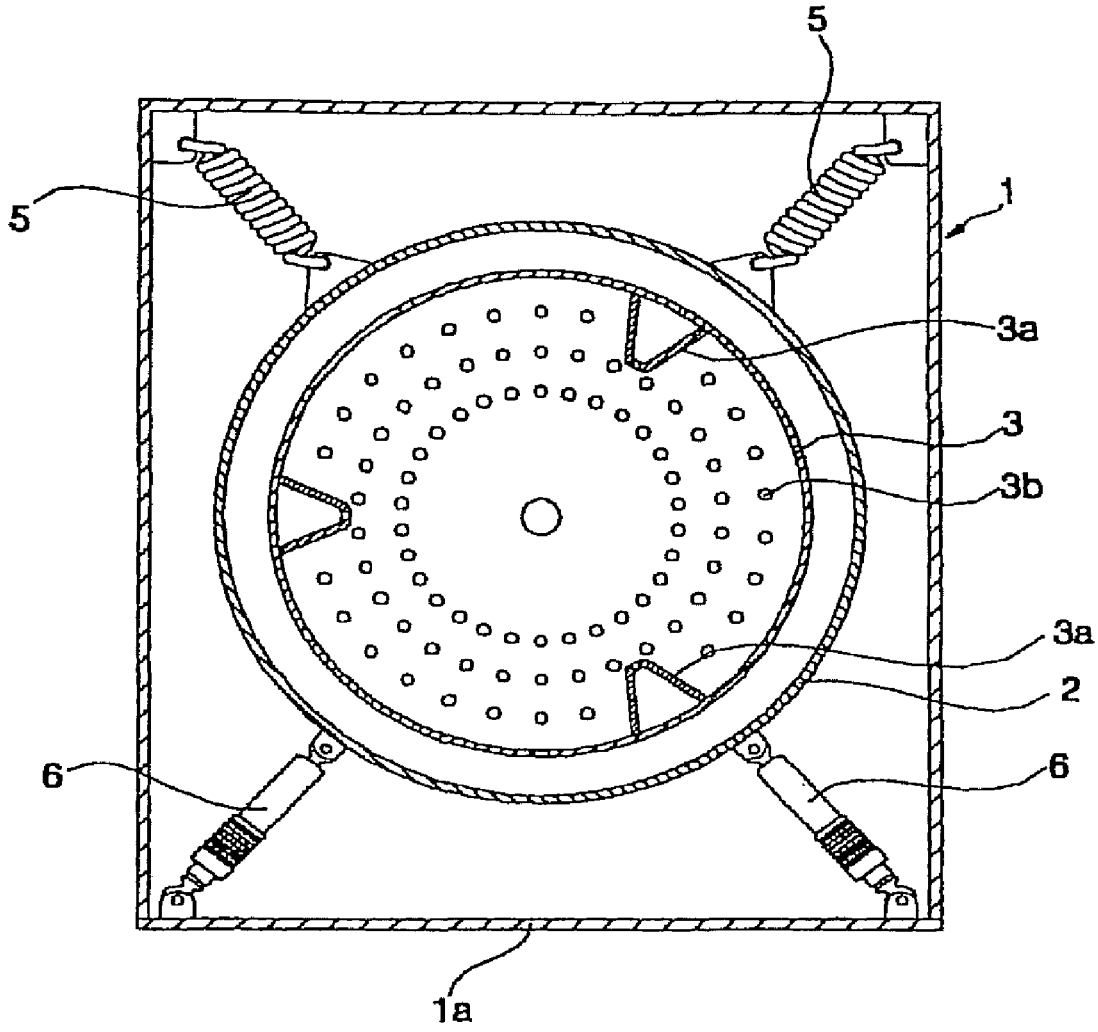
Fig. 2 Related Art
FIG. 2 is a sectional view along line II-II of FIG. 1.
Figure 3:
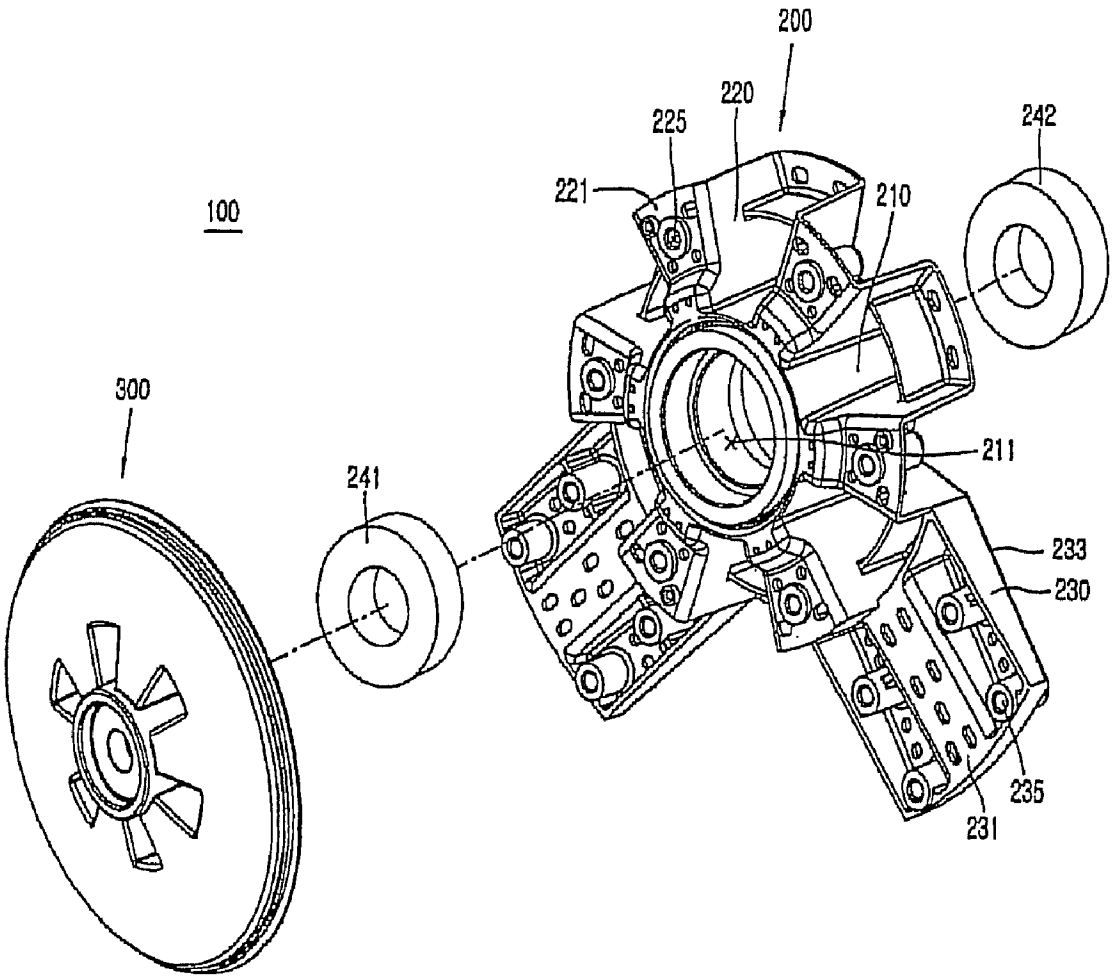
FIG. 3 is an exploded perspective view illustrating a bearing housing assembly provided in a drum type washing machine according to one embodiment of the present invention.

A bearing housing assembly 100 of FIG. 3 includes a first bearing housing 200 and a second bearing housing 300, wherein the second bearing housing 300 may be fixed to the first bearing housing 200 by an injection molding method.

When injection molding is implemented, the second bearing housing 300 is made of a plastic material and is molded to cover at least one outer surface of the first bearing housing 200. A support portion 220 of the first bearing housing 200 is provided with a plurality of through holes, and during the injection molding process, melted plastic flows into the through holes and hardens so as to enhance bonding strength between the first bearing housing 200 and the second bearing housing 300.

Referring to FIG. 3, at least two coupling portions 230 are provided with a plurality of through holes in the same manner as the support portion 220. Thus, if the coupling portion 230 is also covered by the second bearing housing 300 along with the support portion 220, it serves to increase the bonding strength between the first bearing housing 200 and the second bearing housing 300.

Furthermore, the support portion 220 is provided with circumferential ribs, and the strength and rigidity of the support portion is reinforced by the ribs. The ribs are located in the concave portions so as to connect convex portions in between.

The first bearing housing 200 includes a hub 210 into which bearings 241 and 242 are inserted, the support portion 220 extends from the outer circumference of the hub 210 and includes first female threaded holes 225, and the coupling portion 230 extends from the support portion 220 and includes second female threaded holes 235.

Figure 7:
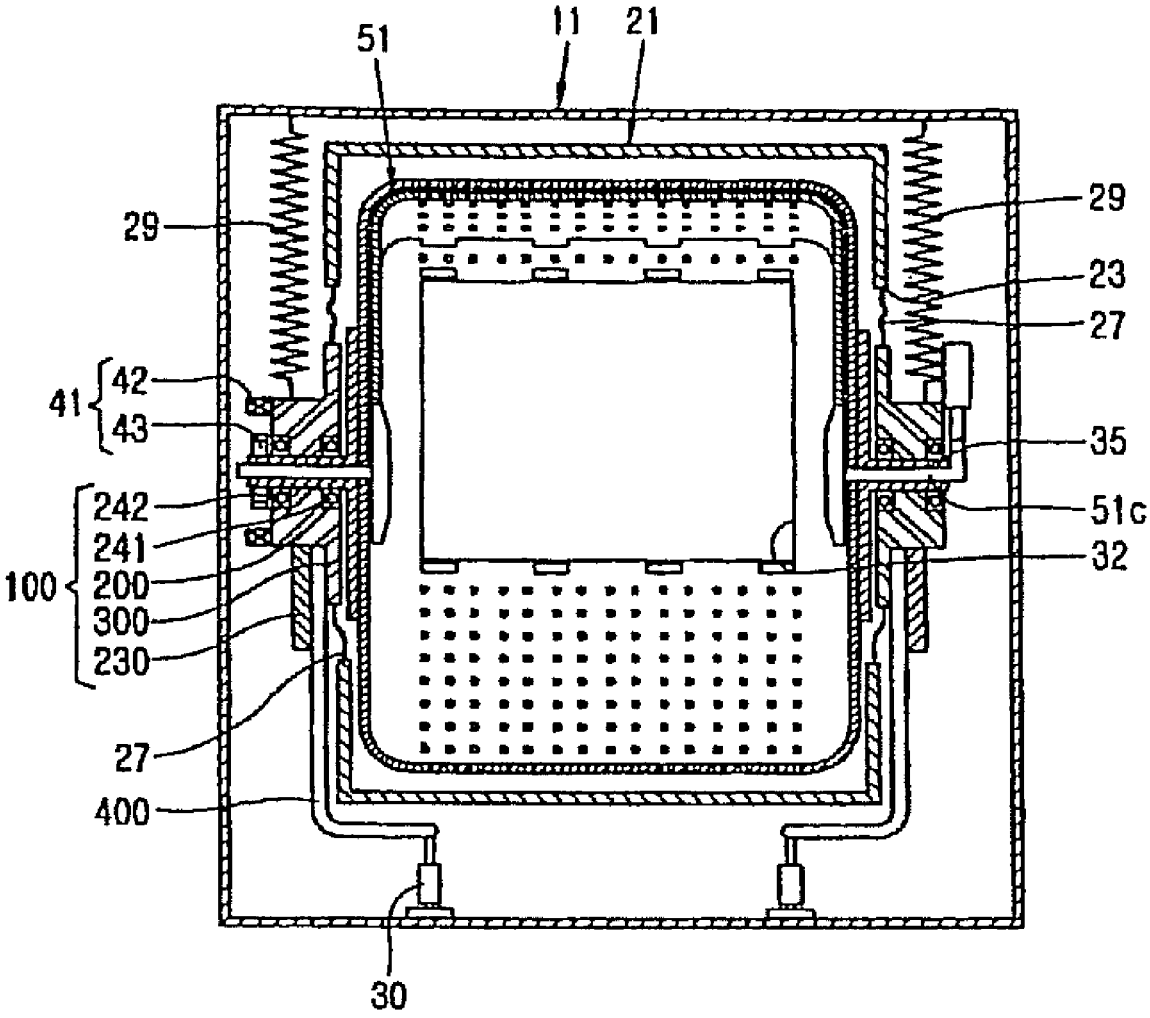
FIG. 7 is a front sectional view illustrating a drum-type washing machine according to first embodiment of the present invention.

The first bearing 241 and the second bearing 242 are inserted on either side of a central opening 211 of the hub 210 to rotatably support a drum rotational shaft 35 (see FIG. 7).

Figure 4:
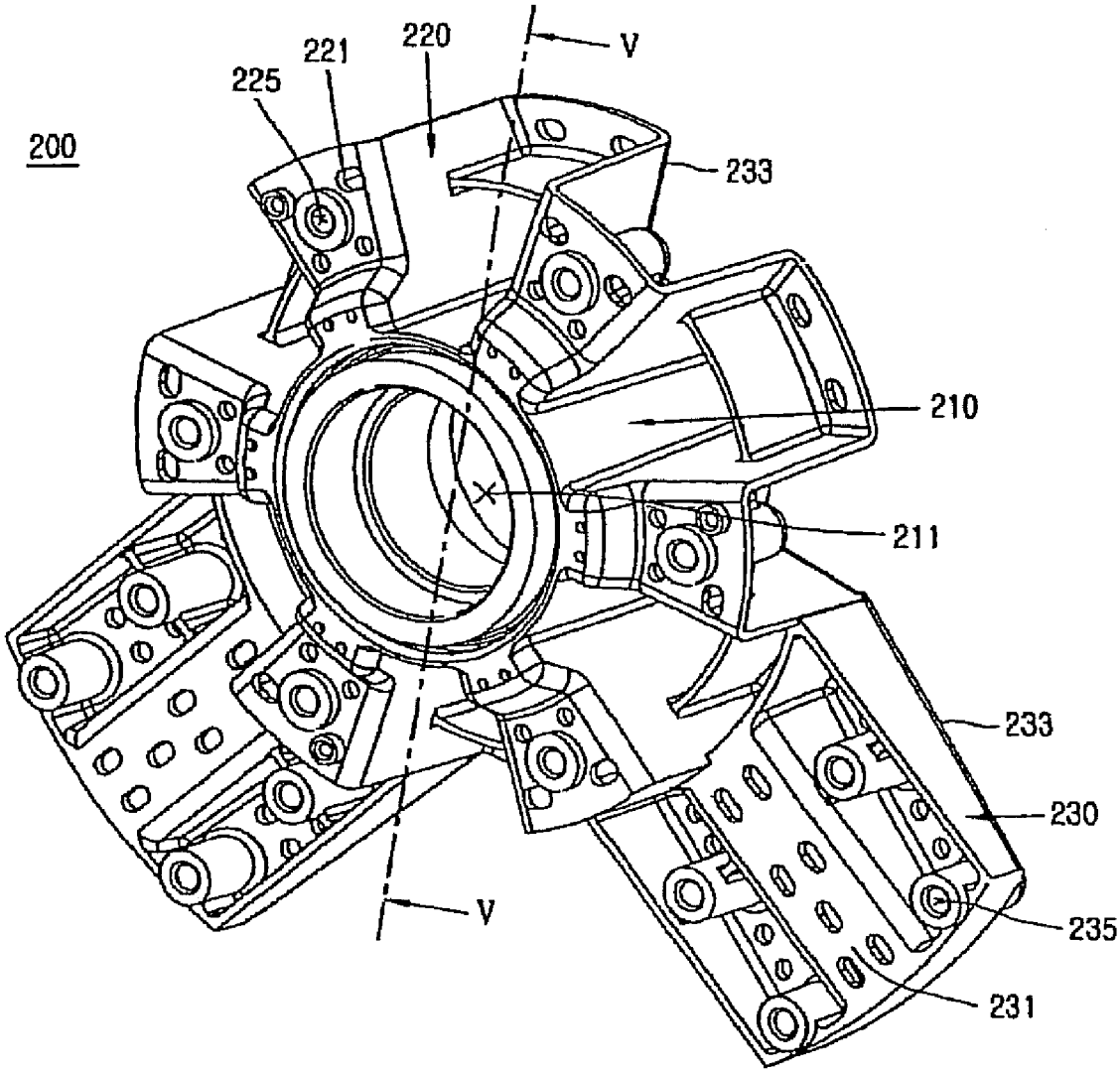
FIG. 4 is a perspective view illustrating an first bearing housing of FIG. 3, viewed from a front side.
Figure 5:
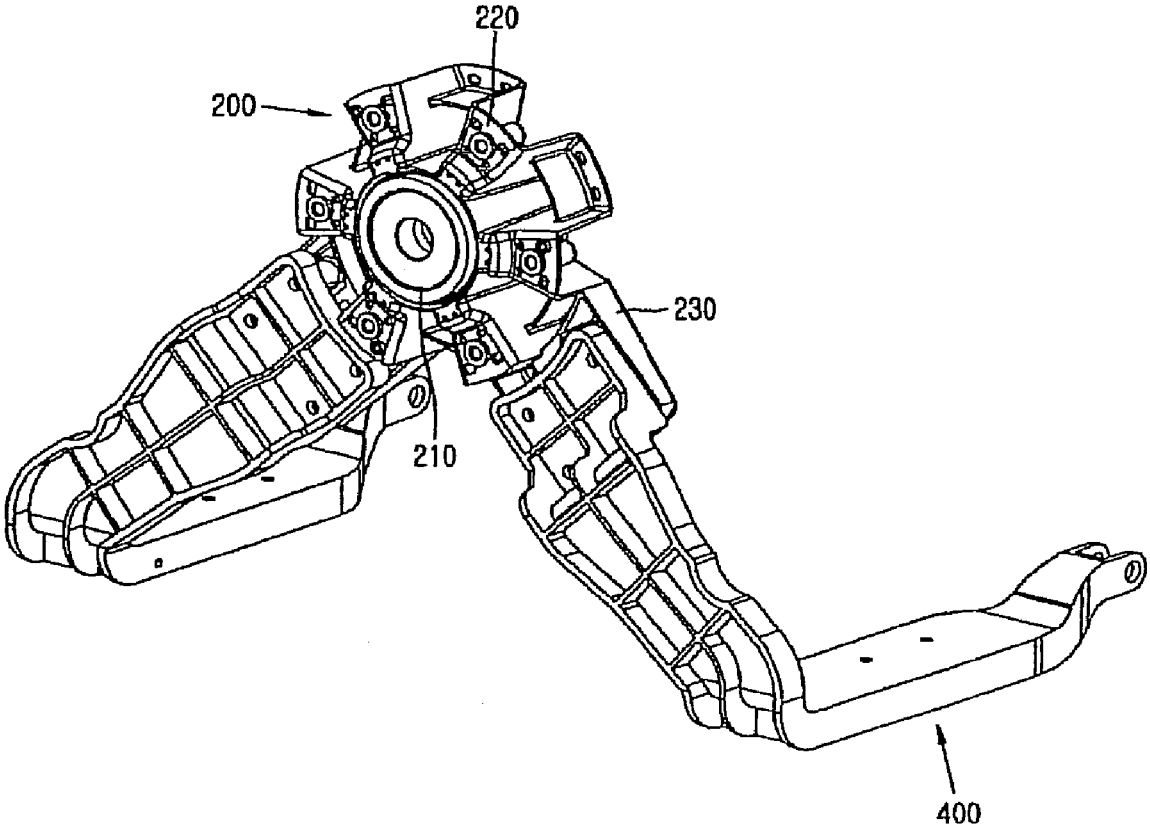
FIG. 5 is a perspective view illustrating a damper bracket fixed to the first bearing housing of FIG. 4, viewed from a rear side of the first bearing housing.
Figure 6:
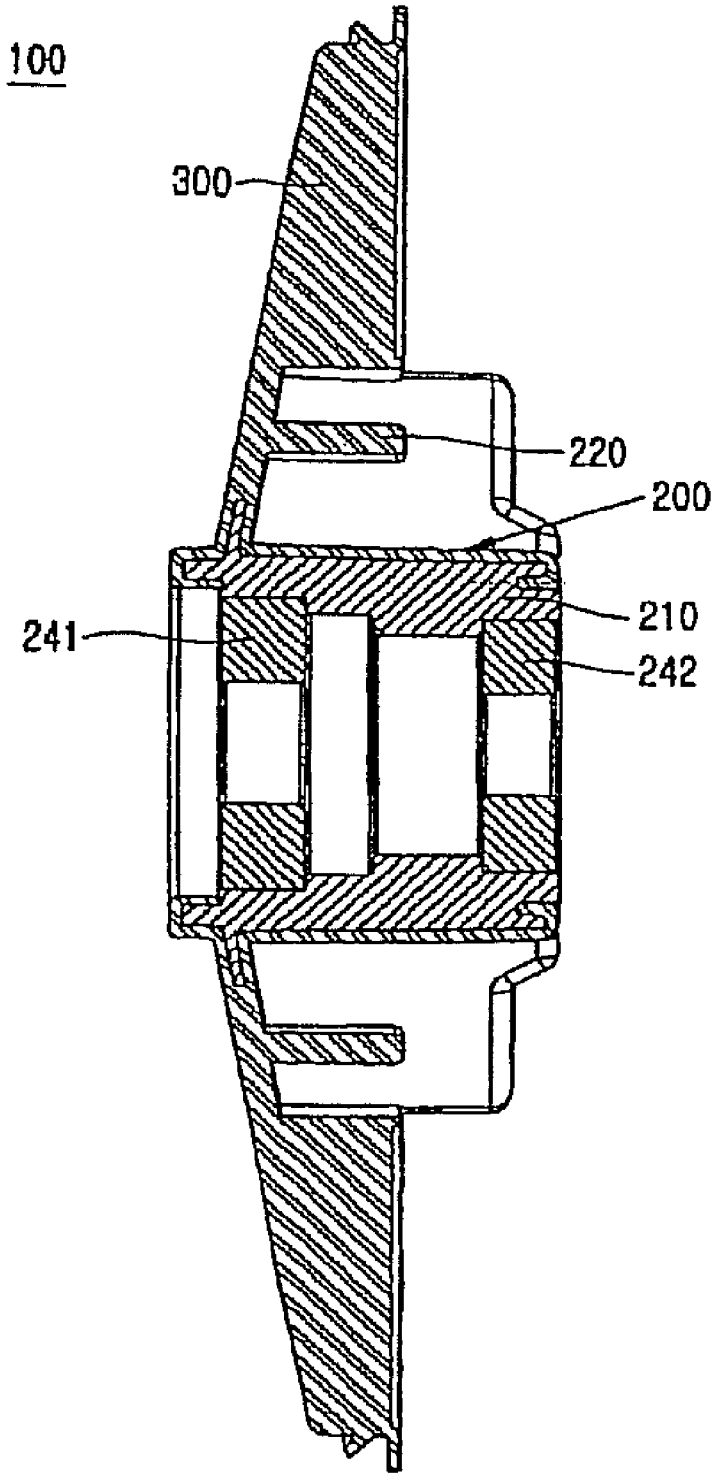
FIG. 6 is a sectional view along line V-V of FIG. 4.

The support portion 220 extends radially from the outer circumference of the hub 210 and has concave portions and convex portions in an alternating pattern. The support portion 220 is manufactured from, for example, a thin laminate having a plate thickness of 2 mm to 3 mm. As shown in FIGS. 3-5, a concave portion at one side of the support portion 220 is a convex portion at the other. Namely, a concave portion at the opposite side of the support portion 220 to the drum is a convex portion at the side where the drum is located.

As shown in FIG. 4, the convex portions on the rear surface of the support portion 220 are provided with first female threaded holes 225. In this embodiment, the rear surface is defined as the side opposite the side where the drum is located. The holes 225 are located in the aforementioned circular ribs. The ribs support the holes 225.

A stator of a motor can be fixed to the support portion 220 through the first female threaded holes 225. In the case where the stator of the motor is fixed to the support portion 220, the convex portions on the rear surface 223 of the support portion 220 are stepped so as not to interfere with a coil of the stator. Thus, the stator can be fixed to the support portion 220 more securely and a portion of the stator is now recessed within the support portion 220 thereby reducing the area necessary inside the cabinet.

The coupling portion 230 is extended from the hub 210 and protrudes further than the support portion 220. The coupling portion 230 can extend from the hub 210 several different ways. For example, the coupling portion 230 could be integral with the support portion, whereby the hub 210, the support portion 220 and the coupling portion 230 are all one piece or the coupling portion 230 can be manufactured separately and fixed to the support portion 220

The coupling portion 230 is coupled to the damper bracket. Accordingly; the coupling portion 230 has a thickness great enough to endure the loaded force. For example, the coupling portion 230 has a plate thickness greater than that of the support portion.

Next, the second bearing housing 300 is fixed to the front surface of the first bearing housing 200. The front surface 221 of the support portion 220 is covered by the second bearing housing 300 by injection molding, for example. The second bearing housing 300 can be made of a plastic material, and the first bearing housing 200 can be made of metal material, for example, aluminum.

The second bearing housing 300 may be formed to cover the coupling portion 230 as well as the support portion 220. Also, the second bearing housing 300 may be formed to cover one side or both sides of the first bearing housing 200.

As the bearing housing assembly is made by injection molding with an insert of the first bearing housing 200, it is not necessary to separately manufacture and assemble various parts, whereby the manufacturing process is simplified and the difficulties in assembling the washing machine are reduced.

Furthermore, since the first bearing 241 and the second bearing 242 are disposed together within the hub 210, misalignment of the shaft between the bearings 241 does not occur.

Moreover, the coupling portion 230, to which relatively great load is applied may be made of a rigid material, and the support portion 220 may be made of a thin plate, whereby the weight and size of the washing machine is reduced.

In a first embodiment, the drum-type washing machine may be provided with a bearing housing assembly which will be described with reference to FIG. 7.

FIG. 7 is a front sectional view illustrating the drum-type washing machine, especially a top loading drum-type washing machine provided with a bearing housing assembly.

The basic structure of a top loading drum-type washing machine is well known.

In the present application, the top loading drum-type washing machine includes a cylindrical cabinet 11 provided with an opening formed at one surface thereof, wherein a door is provided in the opening to allow the loading of laundry in and out of the washing machine.

Tub 21 is formed as a single body including an opening that corresponds to the opening of the cabinet 11 to load the laundry and through holes 23 at either side of the tub 21. A drum 51 is rotatably received within the tub 21 and is provided with the opening formed at one area of a circumferential surface, wherein the opening is aligned with the opening in the tub 21 to allow the loading of laundry in and out of the washing machine.

Furthermore, the top loading drum-type washing machine includes a bearing housing assembly 100 by which a drum rotational shaft 35 of the drum 51 is supported, wherein two bearing housing assemblies 100 are located at both sides of the tub 21.

A drum door 32 is rotatably disposed in the opening of the cabinet around a door rotational shaft 51*c* so as to open and close by rotating about the shaft 51*c*. A controller (not shown) is provided to control the drum 51 during wash cycles.

In the aforementioned top loading drum-type washing machine, the bearing housing assembly 100 includes an first bearing housing 200 and a second bearing housing 300 as described above, and supports the drum rotational shaft 35 fixed to the drum 31.

The first bearing 241 and the second bearing 242 are inserted within the opening 211 of the hub 210 of the inert housing 200, and rotatably support the drum rotational shaft 35. Moreover, a water seal (not shown) is inserted between the second bearing housing 300 and the front surface 221 of the support portion 220, and serves to prevent water from the tub 21 from flowing to the bearing housing assembly 100.

A stator 42 of a drum driving motor 41 is fixed to the rear surface 223 of the support portion 220 of the first bearing housing 200 by fitting bolts into the first female threaded holes 225. A rotor 43, corresponding to the stator 42, is fixed to the drum rotational shaft 35.

A gasket 27 is provided between the tub 21 and the bearing housing assembly 100 in the through holes 23 of the tub 21 so as to prevent water inside the tub 21 from leaking into the cabinet. The gasket 27 is flexible enough to prevent vibration transfer from the bearing housing assembly 100 to the tub 21.

Moreover, one end of a damper bracket 400 is fitted through the second female threaded holes 235 formed in the coupling portion 230 of the first bearing housing 200. The other end of the damper bracket 400 is fitted to the damper 30 to allow the damper 30 to damp vibration of the drum 31.

The damper bracket 400 is shown to have an inwardly bent shape. However, the damper bracket 400 may have any shape. In this embodiment, the damper bracket 400 is inwardly bent to position the bracket close to the center of gravity of the drum 31, whereby the damper can more stably damp vibration of the drum.

In FIG. 7, a spring 29 is provided between the cabinet and the bearing housing assembly.

In the above embodiment, while the top loading washing machine has been exemplarily described, the present invention can be applied to a front loading washing machine.

Figure 8:
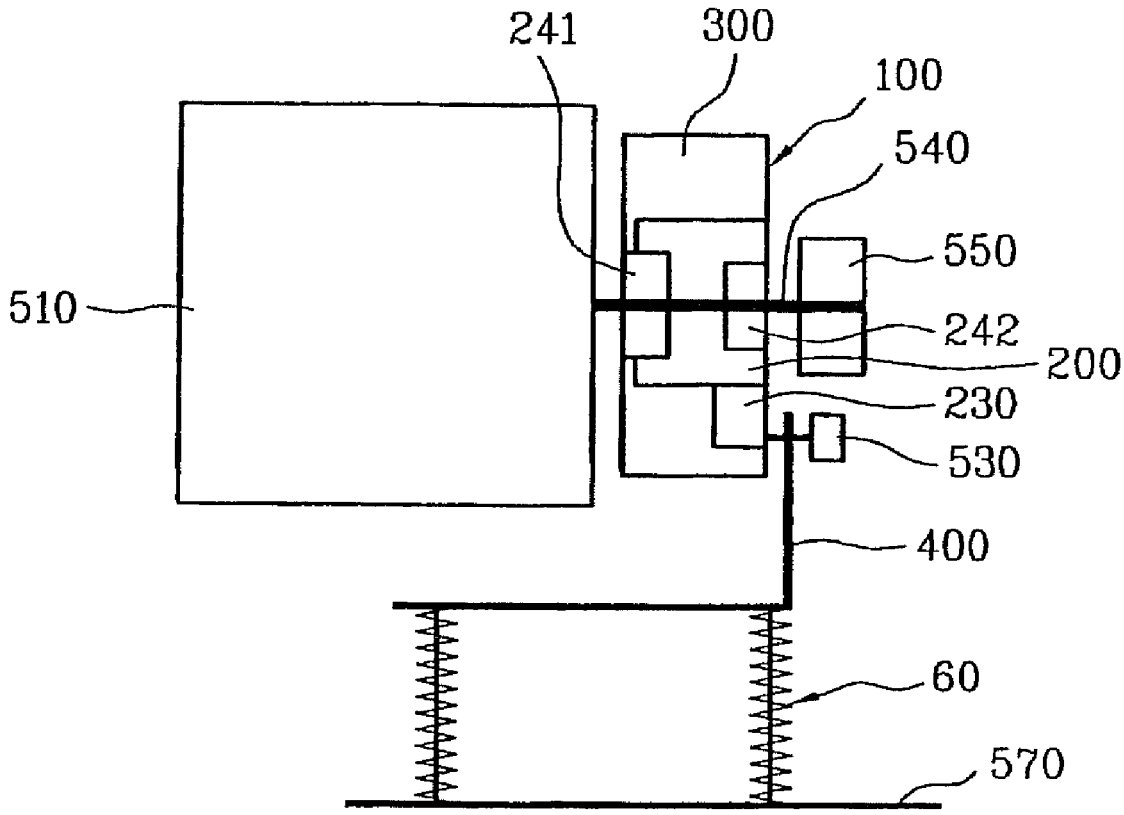
FIG. 8 is a sectional view illustrating a drum-type washing machine according to second embodiment of the present invention.
Figure 9:
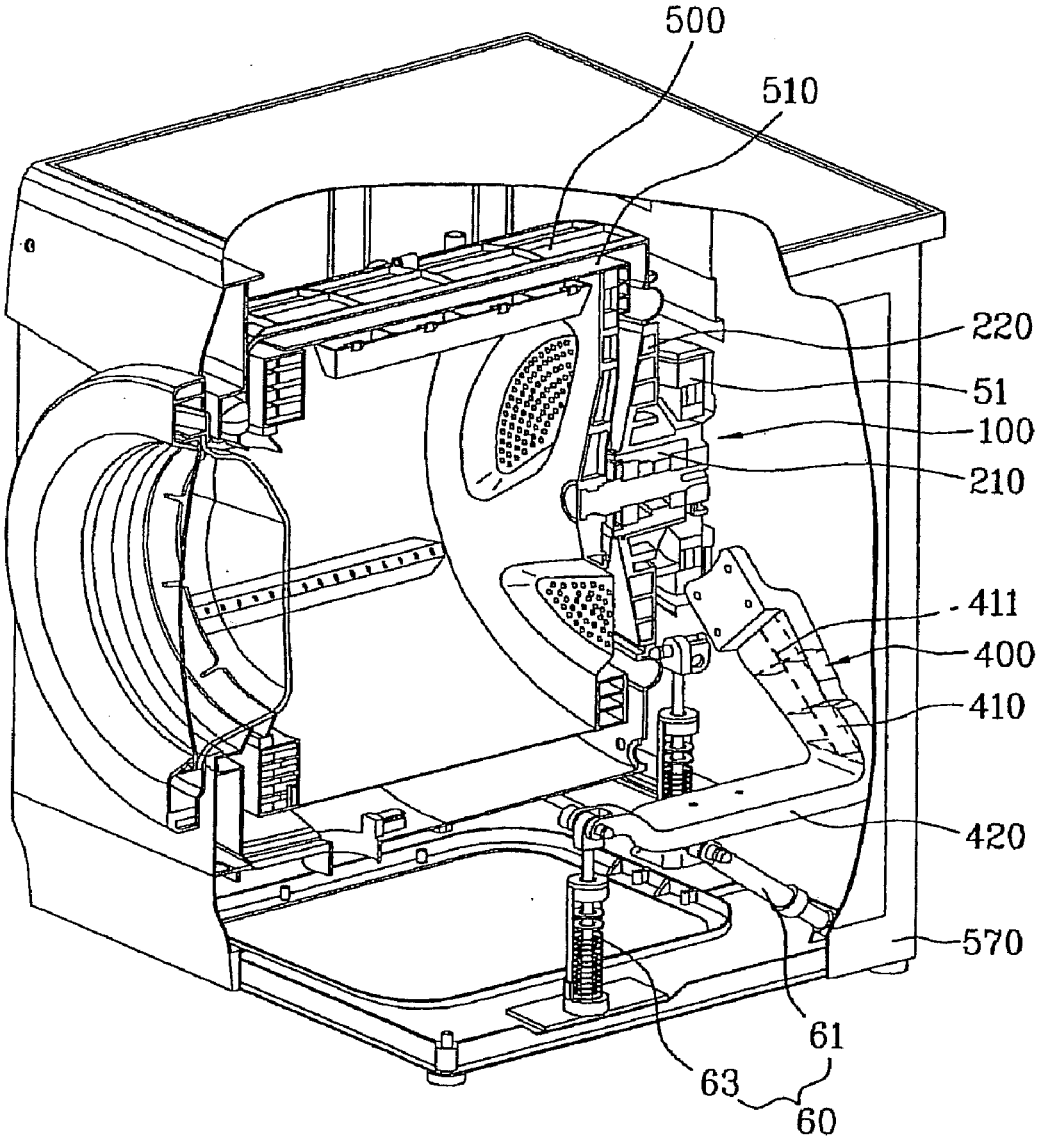
FIG. 9 is a perspective view of the drum type washing machine in FIG. 8 with a partial cut away view.

FIG. 8 illustrates a section of a drum type washing machine in accordance with a second embodiment of the present invention schematically, and FIG. 9 illustrates a perspective view of the drum type washing machine in FIG. 8 with a partial cut away view.

Referring to FIGS. 8 and 9, the drum type washing machine may include a cabinet 570 defining an exterior of the drum type washing machine, a drum 510 rotatably provided in the cabinet 570, a rotating shaft 540 for rotating the drum 510, and a motor 550 connected to the rotating shaft 540. The drum type washing machine may include a bearing housing assembly 100 configured to support the rotating shaft 540. The bearing housing assembly 100 may include a first bearing housing 200 for direct support of the rotating shaft 540, and a second bearing housing 300 disposed on an outside of the first bearing housing 200.

The drum type washing machine also may include a suspension device 60 for attenuating vibration transmitted from the drum to the cabinet 570. A damper bracket 400 configured to support the bearing housing assembly 100 may be provided between the suspension device 60 and the bearing housing assembly 100.

In detail, the damper bracket 400 may have one side coupled to a lower side of the bearing housing assembly 100 with a coupling portion 230, and the other side fixedly secured to the suspension device 60. The suspension device 60 may be projected from a bottom of the cabinet 570, and may include attenuating members, such as dampers or springs.

In the embodiment, a plurality of the coupling portions 230 are formed in an outward radial direction from the bearing housing assembly 100, for an example, at least two as illustrated in FIGS. 3-5. The damper bracket 400 may be coupled to each of the second fastening bosses 235 of the coupling portions 230. The number of coupling portions 230 and damper brackets 400 used is not limited to two, rather, appropriate variations thereof are envisioned and are within the scope of the invention. Such variations may accommodate a range of situations, such as different load capacities or structural requirements.

As illustrated in FIG. 9, the damper bracket 400 may include an extension portion 410 and a connection portion 420 bent from the extension portion 410. In the illustrated exemplary embodiment, the extension portion 410 is extended downward in a radial direction from the bearing housing assembly 100, and the connection portion 420 extends from a bend in the damper bracket 400, the bend disposed at an end of the extension portion 410. Preferably, a plurality of the damper brackets 400 are provided, and more preferably, the damper brackets 400 are provided symmetrically under the bearing housing assembly 100. As a result, the extension portion 410, extended from a lower side of, and in the radial direction of the bearing housing assembly 100, uniformly distributes force to the damper bracket 400.

The connection portion 420 may transmit the distributed force from the extension portion 410 to the suspension 60. In detail, the connection portion 420 may be mounted substantially parallel to the bottom of the cabinet 570, and may be connected to a first suspension 61 having a damper and a second suspension 63 having a spring at an underside of the connection portion 420. Alternate dampers and configurations may be employed in order to accommodate various systems and structural requirements without departing from the scope of the invention.

The extension portion 410 may have reinforcing ribs 411 configured to reinforce the strength of the damper bracket 400, enhancing its strength to improve its ability to sustain the forces exerted on the extension portion 410.

Further, it is noted that the second bearing housing 300 may be connected to the first bearing housing 200 on a front side of the first bearing housing 200, i.e., on a front side of the supporting portion 220.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A washing machine, comprising:

a tub that holds washing fluid therein;

a drum rotatably provided in the tub;

a shaft connected to the drum;

a bearing housing that rotatably supports the shaft; and a suspension system that supports the drum, the shaft and the motor, comprising:

a first damper bracket attached to the bearing housing and having a first axial leg that extends in a rotational axis direction of the drum;

a second damper bracket attached to the bearing housing and having a second axial leg that extends in the rotational axis direction of the drum; and wherein the first and second damper brackets form a predetermined angle therebetween such that a distance between first ends thereof that are attached to the bearing housing is less than a distance between the first and second axial legs.

2. The washing machine of claim 1, wherein the first axial leg of the first damper bracket comprises a first end and a second end that are spaced apart from each other in the rotational axis direction, the second end being spaced further from the bearing housing than the first end, and wherein a width of the second end is smaller than a width of the first end.

3. The washing machine of claim 1, wherein the first axial leg of the first damper bracket comprises a first end and a second end that are spaced apart from each other in the rotational axis direction, the second end being spaced further from the bearing housing than the first end, and wherein the second end is disposed higher than the first end.

4. The washing machine of claim 1, wherein the suspension system further comprises:

a first hinge hole formed in a transverse direction in a distal end of the first leg of the first damper bracket; and a first damper coupled to the first hinge hole.

5. The washing machine of claim 1, wherein the first damper bracket further comprises a first radial leg that is directly attached to the bearing housing and extends outward in a radial direction of the drum.

6. The washing machine of claim 5, wherein the first radial leg is connected to the first axial leg by a first bend that changes an extending direction of the first damper bracket.

7. The washing machine of claim 1, wherein the first axial leg is positioned along an outer circumferential surface of the tub, and a distal end of the first axial leg is inclined toward the outer circumferential surface of the tub.

8. The washing machine of claim 7, wherein the suspension system further comprises:

a first hinge hole formed in a transverse direction in the inclined distal end of the first axial leg of the first damper bracket; and a first damper coupled to the first hinge hole.

9. The washing machine of claim 1, wherein each of the first axial leg and the second axial leg includes a first end and a second end which are spaced apart from each other in the rotational axis direction, the second end being spaced further from the bearing housing than the first end, and wherein a distance between the respective first ends is smaller than a distance between the respective second ends.

10. The washing machine of claim 1, wherein the first and second damper brackets are arranged symmetrically about a vertical centerline of the shaft.

11. The washing machine of claim 10, wherein the first and second damper brackets are each positioned below the horizontal centerline of the shaft.

12. The washing machine of claim 1, wherein the second damper bracket further comprises a second radial leg that is directly attached to the bearing housing and extends outward in a radial direction of the drum, with the second radial leg connected to the second axial leg by a second bend that changes an extending direction of the second damper bracket.

13. The washing machine of claim 12, wherein the second axial leg is positioned along an outer circumferential surface of the tub, with a distal end of the second axial leg inclined toward the outer circumferential surface of the tub, and wherein a second damper is coupled to a second hinge hole formed in a transverse direction in the inclined distal end of the second axial leg of the second damper bracket.

14. The washing machine of claim 13, wherein the motor is coaxially coupled to the shaft.

15. The washing machine of claim 1, further comprising a gasket provided between the tub and the bearing housing so as to form a seal therebetween and allow the bearing housing to move relative to the tub while the tub remains stationary.

16. The washing machine of claim 1, wherein the tub is rigidly supported by the cabinet and the drum is flexibly supported by the suspension system such that the tub is more rigidly supported in the cabinet than the drum is.

* * * * *